US008074767B1

(12) United States Patent
Denison

(10) Patent No.: US 8,074,767 B1
(45) Date of Patent: Dec. 13, 2011

(54) AERIAL LADDER SYSTEM WITH POWERED RUNGS

(76) Inventor: Orville Douglas Denison, Monrovia, CA (US)

( * ) Notice: Subject to any disclaimer, the term of this patent is extended or adjusted under 35 U.S.C. 154(b) by 0 days.

(21) Appl. No.: 12/852,515

(22) Filed: Aug. 8, 2010

(51) Int. Cl.
*A62B 1/00* (2006.01)

(52) U.S. Cl. ..... 182/42; 182/43; 182/44; 182/194; 182/195; 182/228.1

(58) Field of Classification Search ..... 182/42, 182/43, 44, 194, 195, 228.1
See application file for complete search history.

(56) References Cited

U.S. PATENT DOCUMENTS

| | | | | | |
|---|---|---|---|---|---|
| 154,549 | A | * | 9/1874 | Holzwarth | 198/318 |
| 1,015,939 | A | * | 1/1912 | Brunelle | 198/313 |
| 2,461,429 | A | * | 2/1949 | Larson | 182/41 |
| 2,963,178 | A | * | 12/1960 | Walker | 414/139.5 |
| 3,088,542 | A | * | 5/1963 | Johnson et al. | 182/48 |
| 3,825,107 | A | * | 7/1974 | Cary et al. | 198/313 |
| 4,050,542 | A | * | 9/1977 | Wilson | 182/10 |
| 4,094,381 | A | | 6/1978 | Wilkerson | |
| 4,317,504 | A | | 3/1982 | Artaud et al. | |
| 4,366,591 | A | * | 1/1983 | Zimmerman | 14/71.3 |
| 4,467,889 | A | | 8/1984 | Maubach et al. | |
| 4,570,750 | A | * | 2/1986 | Tsai | 182/44 |
| 4,593,787 | A | * | 6/1986 | Lew et al. | 182/3 |
| 4,941,549 | A | * | 7/1990 | Da-Tan et al. | 182/234 |
| 5,064,022 | A | | 11/1991 | Graham | |
| 5,072,807 | A | * | 12/1991 | Fujita | 182/42 |
| 5,145,031 | A | | 9/1992 | Sprunger | |
| 5,645,139 | A | * | 7/1997 | Liou | 182/44 |
| 6,390,235 | B1 | * | 5/2002 | Tsay | 182/44 |
| 6,755,258 | B1 | | 6/2004 | Hunke et al. | |
| 6,929,113 | B1 | * | 8/2005 | Hoover et al. | 198/812 |
| 6,966,418 | B2 | * | 11/2005 | Crookston | 198/312 |
| 7,178,631 | B2 | * | 2/2007 | Salmi et al. | 182/2.5 |
| 7,308,968 | B2 | * | 12/2007 | Denison | 182/42 |
| 7,422,096 | B2 | * | 9/2008 | Crookston | 198/346 |

* cited by examiner

*Primary Examiner* — Alvin Chin Shue
*Assistant Examiner* — Colleen M Quinn
(74) *Attorney, Agent, or Firm* — Louis Ventre, Jr.

(57) ABSTRACT

An extensible, vehicle-mounted ladder with movable rungs is used to aid in raising and lowering in rescue operations. The ladder includes a rotatable base having storage space to hold extra rungs supporting the variable extended positions of the ladder. The ladder includes a plurality of ladder units or extensible booms. Each ladder unit includes four C-rails. A first ladder unit is attached to the rotatable base and the others extensible therefrom. The ladder includes rungs that slidably engage within two of the C-rails. A drive cable connects the rungs in a closed loop and is powered to enable rung rotation in a closed loop around the ladder units within the C-rails.

8 Claims, 7 Drawing Sheets

AERIAL LADDER SYSTEM WITH POWERED RUNGS

TECHNICAL FIELD

In the field of fire escapes, ladders, or scaffolds, a ladder is supported and pivotably mounted on a supporting base on a vehicle and comprising a plurality of coextensive, elongated, motor operated ladder units, at least one of which is designed to be moved along its longitudinal axis relative to each other into an operative position for supporting a fireman adjacent a structure wherein the ladder comprises a stile supporting movable rungs which aid in raising and lowering in rescue operations, the ladder used for ancillary egress from the structure to facilitate quick escape in case of emergency and capable of employing a torso harness.

BACKGROUND ART

This invention is an improvement over U.S. Pat. No. 7,308,968 (the '968 patent) for a transportable rescue conveyer in that it provides unique powered aerial ladder mechanism that extends the stiles of the ladder to reach a building, ship or oil-drilling platform and also moves the rungs to raise and lower the fireman, a person rescued, and any load the fireman may need to raise or lower with him. Unlike the '968 patent, this improvement provides a powered ladder for a fire and rescue truck that more closely resembles traditional manual-climb ladders, except that it multiplies the lift and rescue potential of fire and rescue personnel. The present invention is distinctly different from the '968 patent in that a single specially designed boom is used that supports and guides the rungs and enables their movement in a loop in a forward or backward direction.

The notion of movable rungs was disclosed for an electrically adjustable ladder in U.S. Pat. No. 5,145,031 (the '031 patent). While not an aerial ladder, the '031 patent teaches the use of threaded screws extending along two parallel stiles through which the rungs are mechanically connected. The present invention does not use the mechanism described in the 031 patent.

U.S. Pat. No. 4,467,889 (the '889 patent) teaches a ladder-guided service elevator to carry persons up or down along a building wall or other structure. The service elevator is not an aerial ladder but rather is similar to a traditional ladder, which must be secured to a structure. The structure then supports an endless conveyor band that engages the rungs of the ladder and the elevator that carries a load up and down. There is no mechanism for extending the ladder-guided elevator or for its operability upon such extension.

Vehicle-mounted retractable ladders without movable rungs are also well known and are common in fire and rescue vehicles. An example from 1982 is U.S. Pat. No. 4,317,504 for a telescopic aerial ladder, especially intended to be mounted on a transportation vehicle. The ladder comprises a number of ladder members superposed atop each other, each member consisting of two trapezoidal lateral wings connected by rungs. The upper and lower longitudinal edges of each member are not in parallel relationship but designed in such a manner that the distance between said edges is increasing towards the end of said member which remains imbedded within the corresponding end of another ladder member which is located near below said member. The present invention's telescopic mechanism is distinctly different in that the telescoping ladder sections are nested within each other, providing for very compact storage atop the vehicle.

A recent example of a non-emergency vehicle application of a retractable ladder is U.S. Pat. No. 5,064,022 (the '022 patent). The '022 patent teaches a ladder apparatus and method for use with large construction equipment, such as large tractors, mining trucks and similar vehicles that have an operator's platform or operating station located a substantial distance off the ground. The powered ladder has a fixed ladder portion rigidly attached to the vehicle. While typical, such ladder mechanisms are distinctly different from the present invention in both structure and capability provided by a unique movable rung system.

SUMMARY OF INVENTION

A ladder with powered rungs is extensible, truck mounted and used to aid in raising and lowering in rescue operations. The ladder includes a rotatable base having storage space to hold extra rungs supporting the variable extended positions of the ladder. The ladder includes a plurality of ladder units or extensible booms. Each ladder unit includes four C-rails. A first ladder unit is attached to the rotatable base and the others extensible therefrom. The ladder includes rungs that slidably engage within two of the C-rails. A drive cable connects the rungs in a closed loop and is powered to enable rung rotation in a closed loop around the ladder units within the C-rails.

Optionally, a spring-loaded take-up spool holds the drive cable and rungs in the storage space of the rotatable base; a redundant power supply includes controls at the rotating base and at the top end of the ladder units; a rung-release mechanism enables a person on the ladder to make a controlled gravity-assisted descent; a platform with side rails at the top end of the ladder units enables a person to stand and manipulate a fire hose or other rescue operation; a belt below the rungs rotates with the rungs to prevent a foot or hand from snagging; an inflatable slide attached to the rotatable base enables a person to slide down from the rotatable base to the ground.

Optionally, a powered platform is attached to the rotatable base to provide descent to ground level for incapacitated victims and will assist in raising gear and personnel up to the ladder at the top of the rotatable base.

Technical Problem

Current ladder systems require an exhausting regimen of manual climbing and descending, often carrying heavy loads, in order to perform rescue operations. A system is needed to substantially ease the climbing and descent burdens on rescue personnel by providing a powering mechanism suitable for application to fire trucks and other rescue vehicles.

Solution to Problem

The solution is a telescoping aerial ladder system with a unique boom enabling powered ladder rungs.

Advantageous Effects of Invention

The ladder system will enable faster response to emergency rescue situations. It will significantly ease the climbing and descent burdens on rescue personnel. It will permit controlled unattended descent of rescued individuals.

BRIEF DESCRIPTION OF DRAWINGS

The drawings illustrate preferred embodiments of the method of the invention and the reference numbers in the drawings are used consistently throughout.

DESCRIPTION OF EMBODIMENTS

Figures 1, 2:
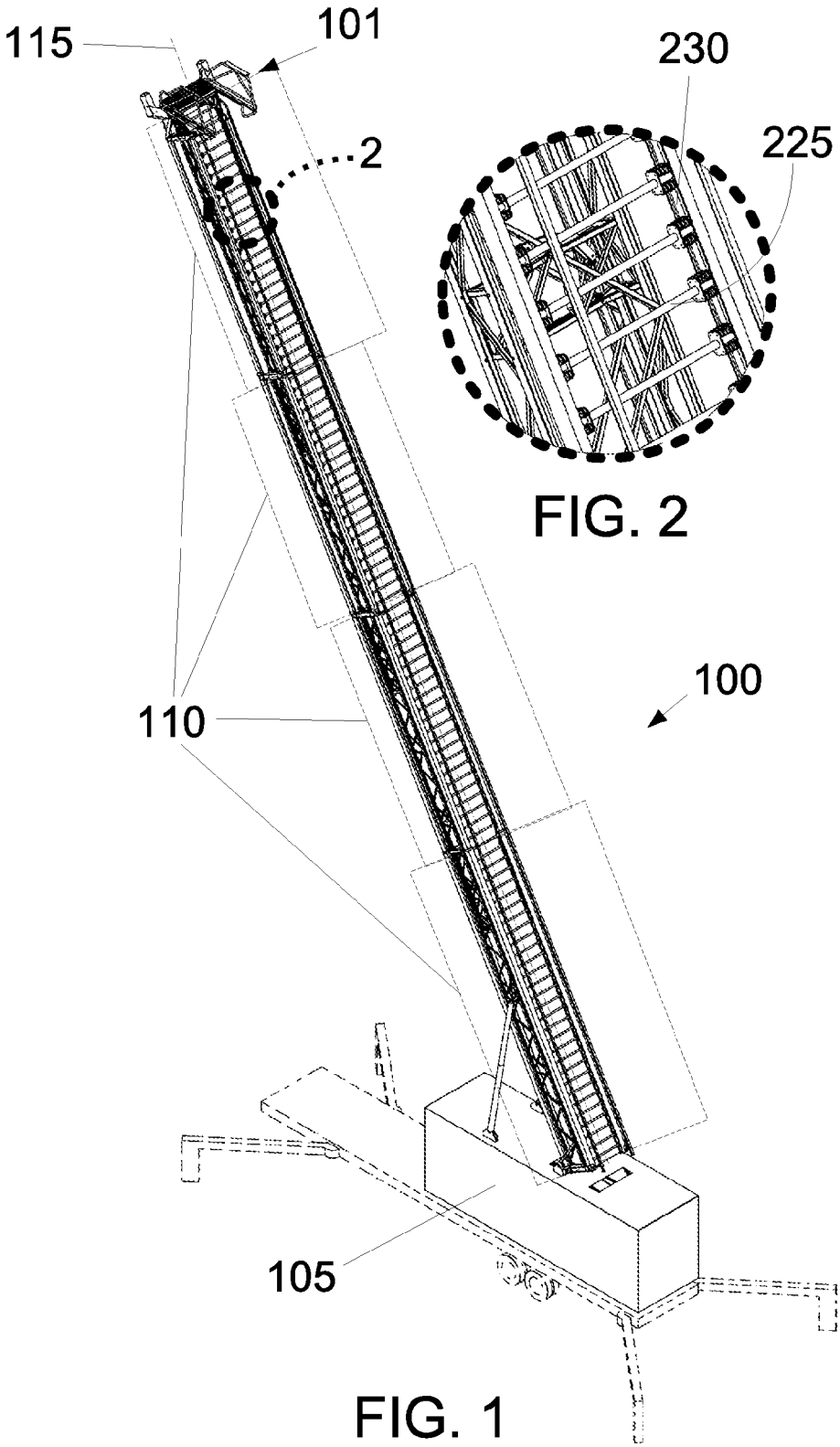
FIG. 1 is a perspective view of the ladder.
FIG. 2 is partial view of the ladder showing C-rails and rungs.

In the following description, reference is made to the accompanying drawings, which form a part hereof and which illustrate preferred embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention. The first digit of each of the 3 digit reference numbers in the drawings represents the figure number.

FIG. 1 shows in perspective a ladder (100) that is extensible, intended to be mounted on a vehicle and useful for raising and lowering in rescue operations. The ladder is an aerial ladder and for simplicity is referred to herein as a ladder (100).

The term vehicle is intended to be interpreted broadly to include: a land vehicle such as a truck, and a trailer (shown in dashed lines in FIG. 1) towed by a truck; and a water-borne vessel such as a barge or ship; or, any other mount that is useful for a rescue operation requiring an aerial ladder. For simplicity, these vehicles may simply be referred to herein as a truck. Similar to ladder trucks and cranes, a land vehicle would typically have extensible trailer stabilizers that rotate out and telescope downward to engage the ground to provide a broad support base to prevent tipping when extending or using the ladder.

The ladder (100) includes a rotatable base (105); ladder units, which are indicated within the dashed enclosures in FIG. 1 identified by reference number (110) and herein referred to as "ladder units (110);" rungs (225); and a drive cable (230).

The ladder (100) is extensible, that is, the ladder units (110) or boom extends outward and upward to access a high building or other elevated spot, and, after use, retracts for storage and transport. The ladder (100) is preferably truck mounted, trailer mounted, or mounted on board a rescue ship. Such mounting enables the ladder (100) to be easily transported to a building location, sea rescue site or other emergency site, as would a typical fire truck, barge mounted crane, or other mobile crane. The ladder (100), especially because it has powered rungs (225), is thus usable to aid in raising and lowering people, fire hoses, and equipment in rescue operations.

Waterways may be included under the C-rails (311). A disabled, rescued person could ride down with straps and hooks attached to the rungs (225). Able bodied fire victims may descend by standing on one rung while holding onto a rung above the victim's head. Preferably, up to three people, equally spaced, would be able to ride down simultaneously, provided they do not exceed engineered weight limits. The system is preferably designed to travel at 200 feet per minute so a 113 foot extension of the ladder units (110) would take less than one minute including soft startup and soft shutdown.

Any powered components discussed herein may employ any powering system, such as gasoline-fueled, natural gas-fueled, hydrogen-fueled or electric motors or hydraulically powered components.

Figure 4A:
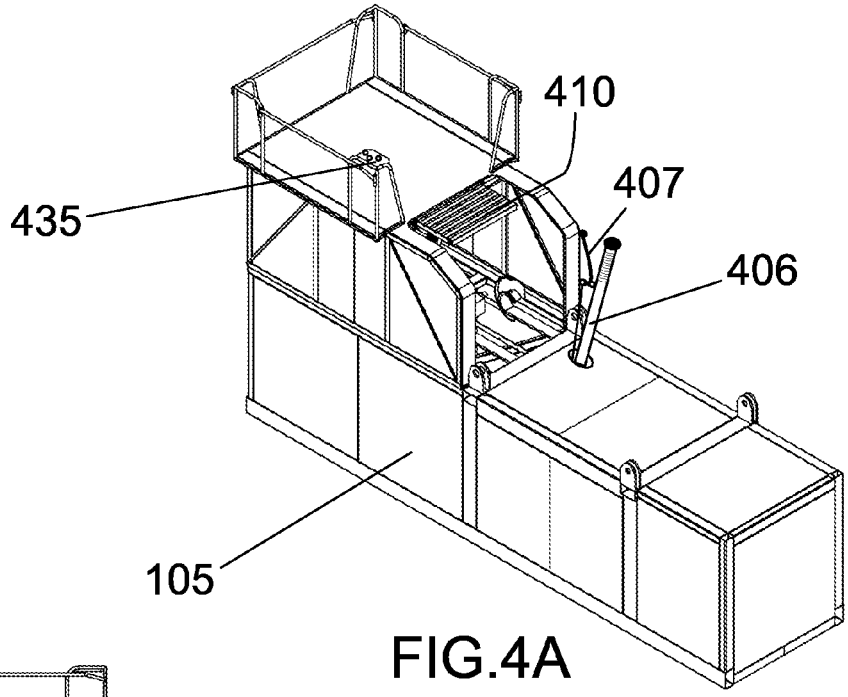
FIG. 4A is a perspective of a rotatable base.
Figure 4B:
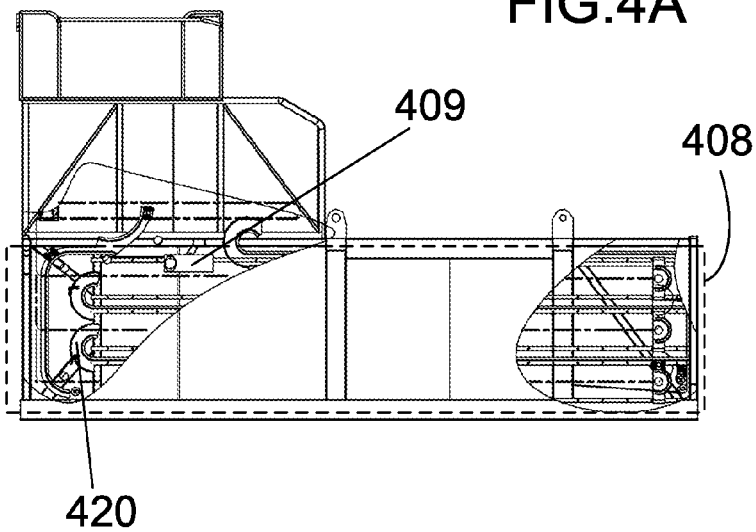
FIG. 4B is a side elevation view of alternative embodiment of the rotatable base with a cut-out showing a take-up spool.
Figure 4C:
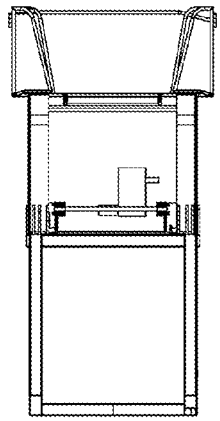
FIG. 4C is an end view of the rotatable base shown in 4B.

The ladder (100) comprises a rotatable base (105) configured to define storage space within, which is approximated by the dashed enclosure (408) shown in FIG. 4 and is herein referred to as "storage space (408)." The rotatable base (105) is preferably a box-like structure with the ladder units (110) attached or mounted to the rotatable base (105). The rotatable base (105) preferably a turntable (510) that enables rotation of the ladder units 360 degrees in any direction so that any emergency situation can be address by the extensible ladder (100).

The ladder units (110) are preferably attached at the top of the rotatable base (105), so that extra rungs can be stored below and within the rotatable base (105) and conveniently extracted when the ladder units (110) are extended. The first and largest of the ladder units (110) is preferably attached to the rotatable base (105) so that it can be elevated to any angle. The remaining ladder unit or units extend from that first ladder unit, as would by typical for the boom of a mobile crane.

The ladder (100) comprises a plurality of ladder units (110), meaning two or more ladder units are included. FIG. 1 illustrates an embodiment with four ladder units. The ladder units (110) are modular so that. For example, two, three, four or more ladder units (110) might be provided. Smaller ladders (100) might be increased in length capability by adding additional ladder units (110) and additional optional belt (320) sections.

Figure 3A:
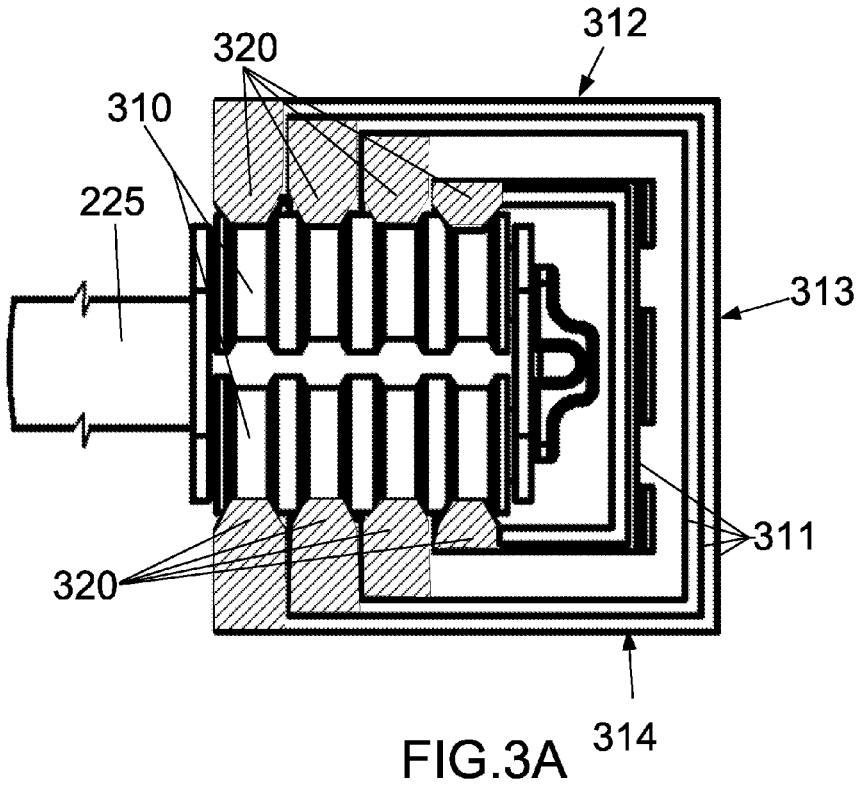
FIG. 3A is a sectional end view of nested C-rails and a rung with rollers.
Figure 5:
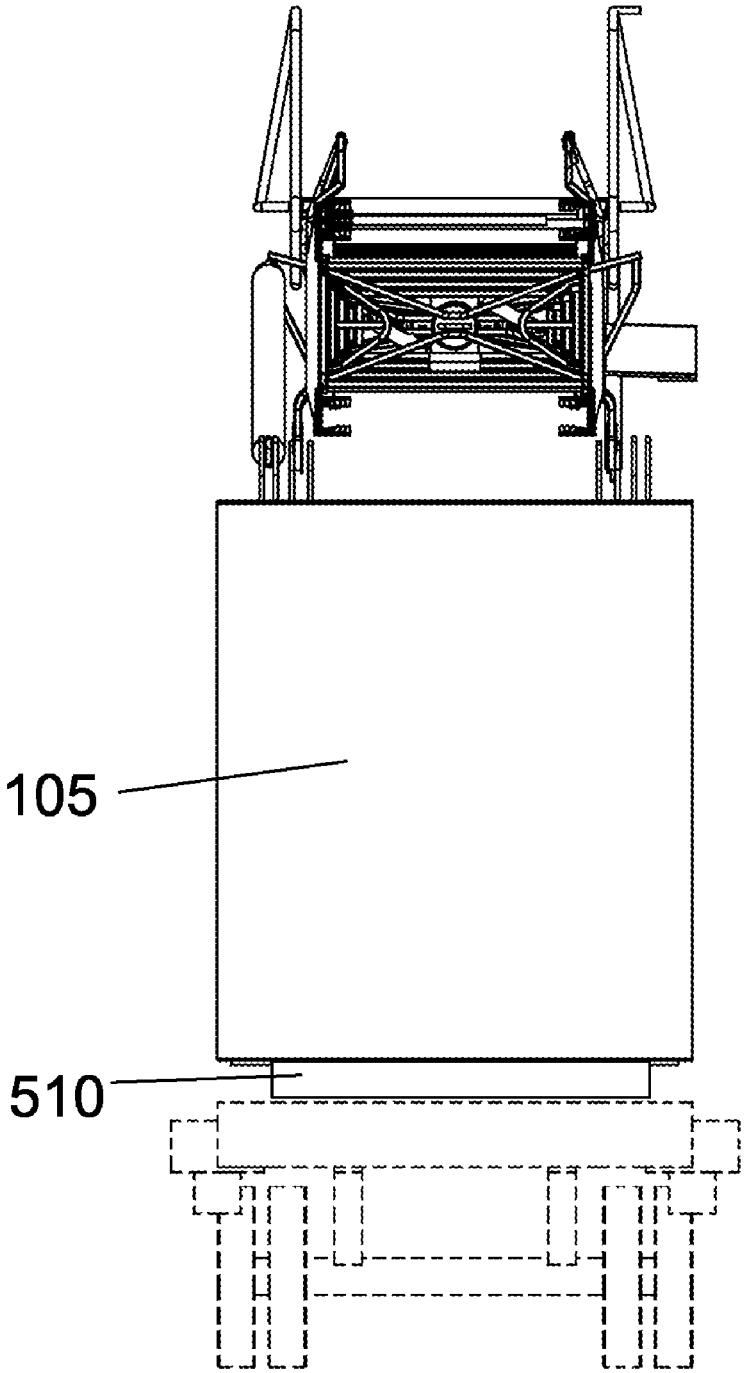
FIG. 5 is an end view of collapsed ladder units on the rotatable base installed on a truck bed.
Figure 6:
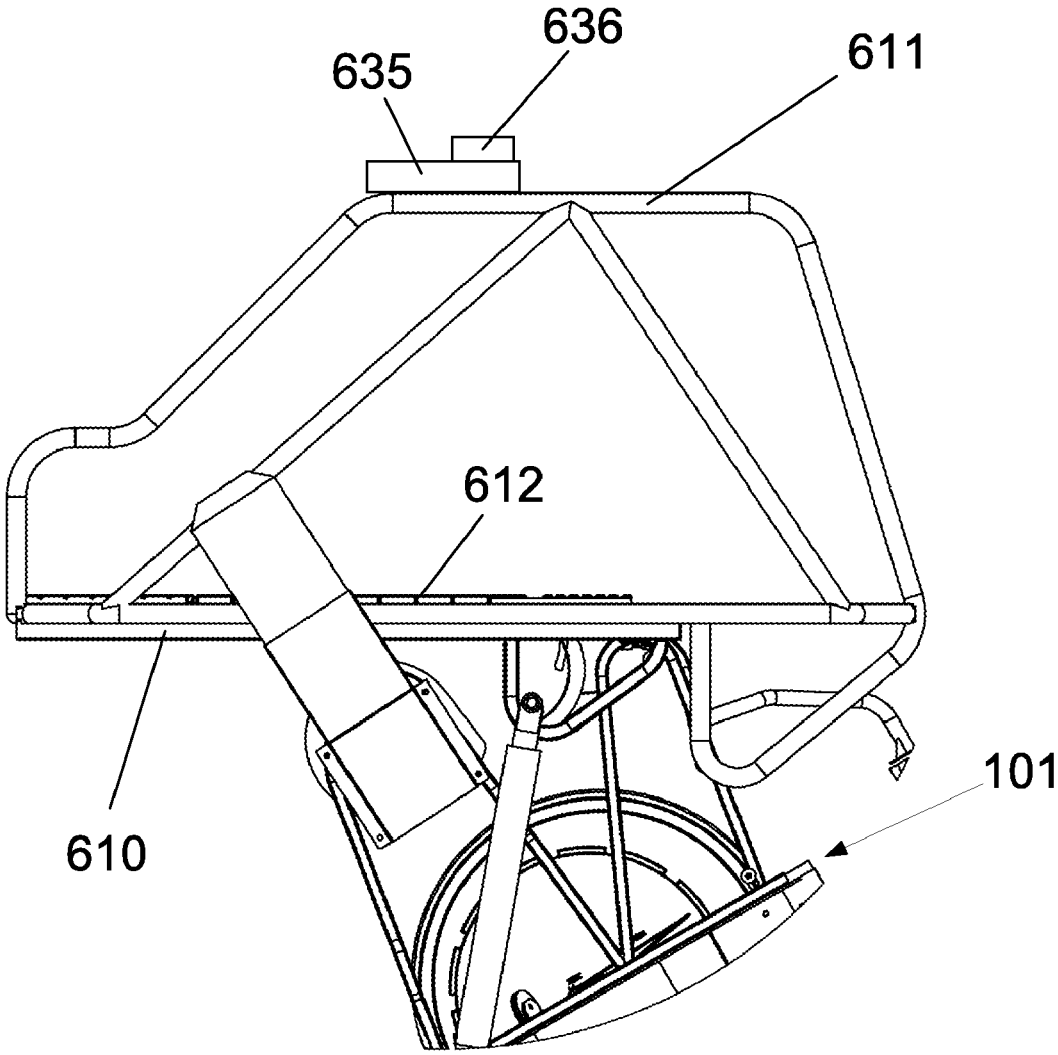
FIG. 6 is a side view of the top end of the ladder units with a platform installed at the end.
Figure 7:
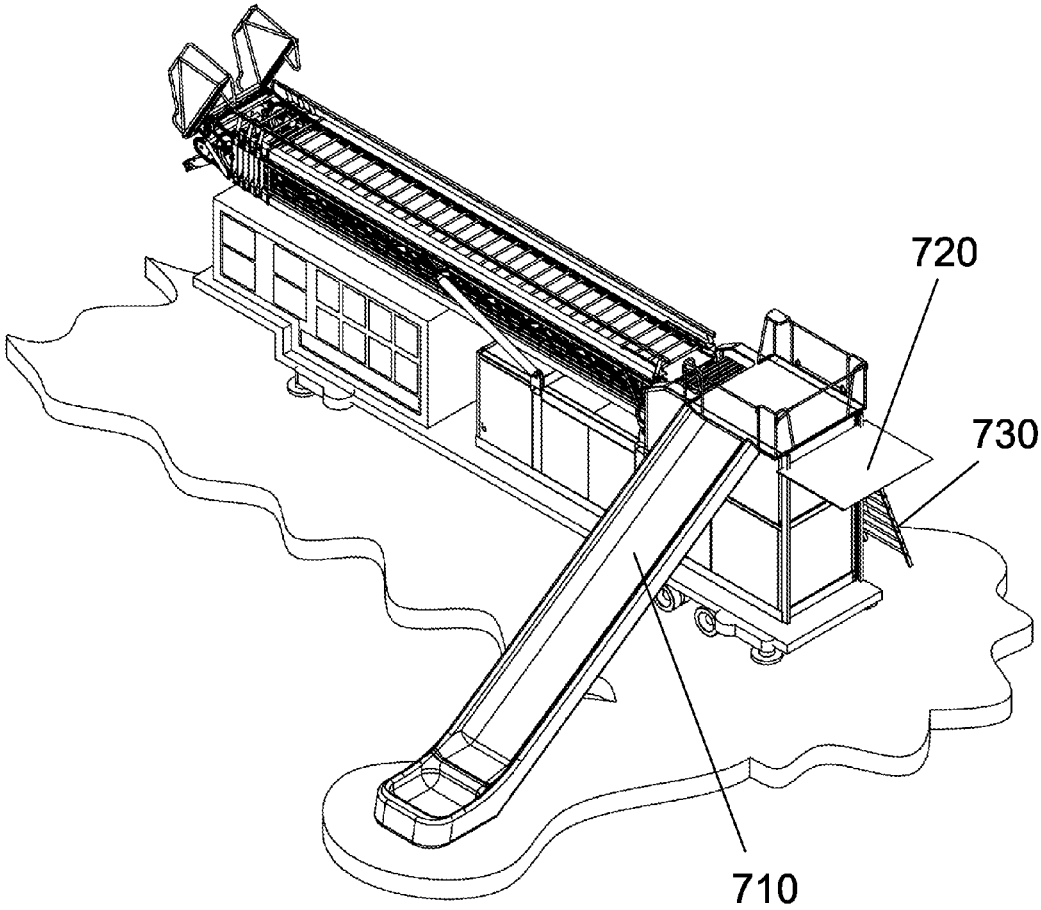
FIG. 7 is a perspective of ladder with an inflatable slide as installed on a truck bed.
Figure 8:
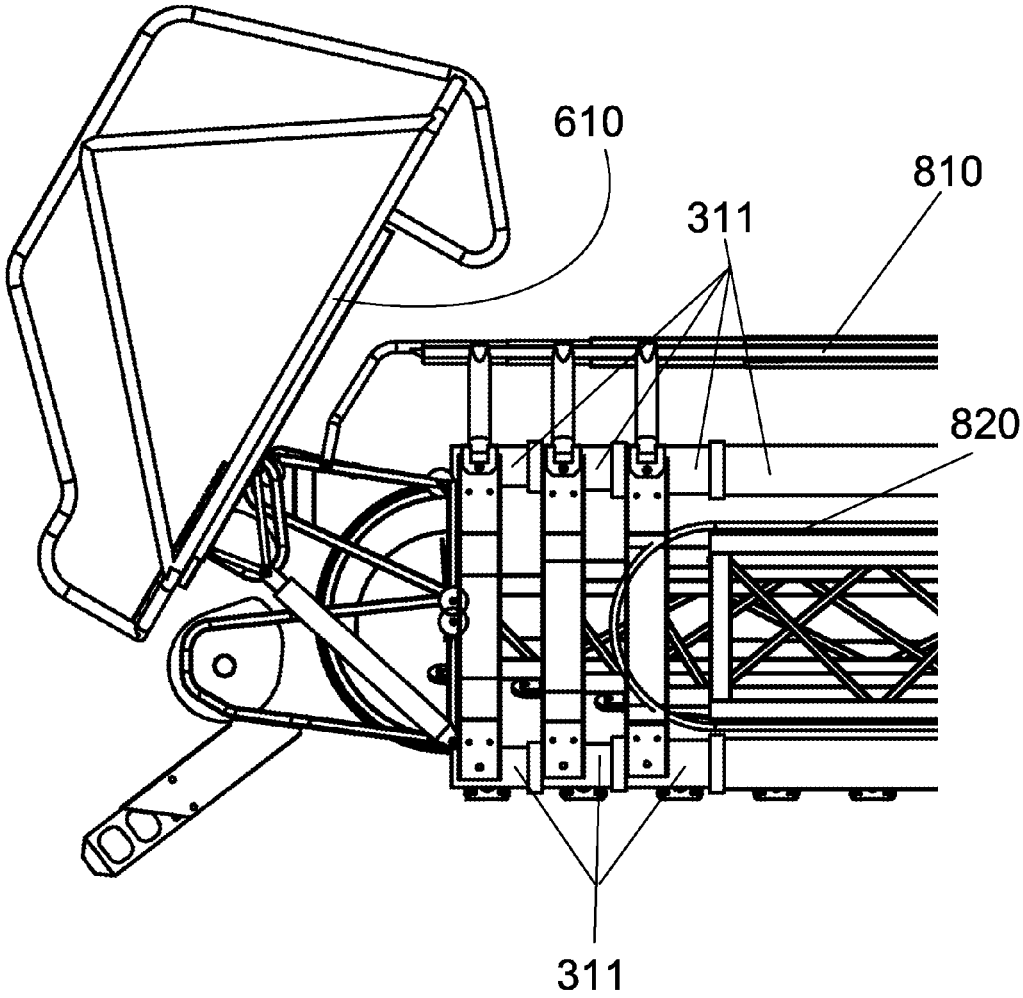
FIG. 8 is a side view of the top end of the collapsed ladder units showing the C-rails.

FIG. 5 shows an end view the ladder units (110) nested together. FIG. 8 shows the ladder units (110) in the perspective. Each ladder unit comprises four C-rails (311), so named because each C-rail (311), as shown in FIG. 3A, typically has a top wall (312) and a bottom wall (314) connected by one side wall (313). It is preferably in cross section, 3-sides of a rectangle.

The ladder units (110) are configured to be nested together. Thus, the C-rails are progressively smaller so as to fit within one another. The ladder units (110) are adapted to be extensible from the rotatable base (105) along a longitudinal axis (115) to a top end (101). A sliding landing cover (410) may be employed at the bottom of the ladder units (110) to assist a person in exiting the ladder units (110) onto the rotatable base (105).

The rungs (225) are configured to slidably engage within two of the C-rails (311). Preferably there is about 14 inches separating any two adjacent rungs (225). In normal operation up the ladder units (110), the rungs move up on the top side between two C-rails (311). The rungs (225) then rotate around the top end (101) and move down the ladder units (110) on the bottom side between two other C-rails (311). Of course, the rungs are powered in either direction so that they can also move down the top side of the ladder units (110) and up the bottom side in a loop. As used herein, "top side" refers to the side of the ladder units (110) facing upward; and, "bottom side" refers to the side of the ladder units facing the ground. Excess rungs (225) are stored in the rotatable base (105) and move in and out thereof in either direction in support of up or down rung movement along the ladder units (110).

The drive cable (230) connects the rungs (225) together in a closed loop. The drive cable (230) may be a chain, wire rope or other connecting mechanism that can be powered, motorized, or otherwise adapted to rotate the rungs around the ladder units within the C-rails (311). Thus, the drive cable (230) extends and retracts the rungs (225) from the storage space (408) in the rotatable base (105) with movement of the ladder units (110) along the longitudinal axis (115).

The rungs (225) preferably have wheel bearing carriages at either end which ride in the C-rails (311). Wheels in such carriages preferably conform to the contours of the inside of the C-rails (311). Such wheels are preferably permanently lubricated and provide lowered friction to enable long term high speed rescue operations with minimal maintenance.

The ladder (100) may include a spring-loaded take-up spool (420) configured to hold the drive cable and rungs in the rotatable base (105). The rotatable base (105) with the take-up spool (420) is also described as a take-up drive module.

The ladder (100) may include a redundant power supply comprising a first control (435) at the rotating base and a second control (635) at the top end (101) of the ladder units (110).

The ladder (100) may include a rung-release mechanism (636) that enables the rungs to move in a controlled gravity-assisted descent with a load on the rungs. The rung-release mechanism (636) releases the rungs (225) to move in the direction manually pulled or downward with the force of gravity for a person or load on the rungs (225). The rung-release mechanism (636) may be a simple electric circuit engaged by a button on the first control (435) or the second control (635) to control an electrically operated brake (409), shown in an alternative embodiment of the rotatable base (105) in FIG. 4B. The rung-release mechanism (636) may also be a lever (406) that is manually engaged when it is desired to enable free movement of the rungs (225) unimpeded by the motor or other mechanism powering the movement of the rungs (225).

The rung-release mechanism (636) preferable includes a manual brake (407) shown in FIG. 4A, to regulate the speed of gravity-assisted descent. For example, the rung-release mechanism (636) may include a clutch that upon engagement frees one or more drive motors allowing the rungs (225) to be moved manually or with gravity. The clutch is preferably operable to disengage the drive motor(s) to enable the rungs (225) to be manually pulled down so that the person being rescued can be lowered to the ground level. As the person reaches the bottom of the travel at ground level the clutch can be disengaged to stop the momentum of the moving rungs (225) with personnel on them.

The rung-release mechanism (636) is preferably operable to enable a fireman at the top to disengage the drive cable (230) from a locked position in a power failure or simply when a fast descent is desired. Should power fail for any reason, a person could also descend the ladder (100) just as one would do on a stationary ladder. In such a power failure event, a disabled rescued person may be placed in a rescue bag and either slid down over the rungs (225), or be accompanied in a gravity-assisted descent.

The ladder (100) may include a platform (610) mounted at the top end (101) of the ladder units (110). This is also known as a "slave operator's station" because the master operator's station is at the base of the ladder units (110) at the rotatable base (105).

The platform (610) is operable to enable a person to stand thereon during a rescue operation. Side handrails (611) on the platform (610) are configured to contain the person within the platform (610). This feature may be helpful for firemen and those rescued to exit a window prior to positioning for descent to the ground.

The platform (610) is preferably hinged so that it can be adjusted to keep it horizontal and to compensate for the angle of the ladder units (110).

The platform (610) preferably comprises extensible flooring (612) that retracts like a roll-up garage door to permit a more compact storage position for the platform (610).

The platform (610) is preferably adapted to slide outwardly to engage a building. In this embodiment, the platform (610) is thus extensible so that will slide in toward the building once it is in close proximity so as to prevent damage to the platform (610) upon arrival positioning. Preferably, there are large rubber shock absorbers at the top end (101) to assist in positioning and to prevent damage to either building or rescue vehicle.

The ladder (100) may include a belt (820) adapted to slidably rotate with the rungs (225) and situated between the four C-rails (311). The belt (820) is in the nature of a "conveyer belt" in that it is preferably about as wide as the rungs (225). The belt (820) moves with the rungs (225) so that the toe of a fireman's boot, the fireman's hand, cuff, or other component attached to the fireman and moving on a rung (225) may not engage a stationary component below the rungs and cause injury. Excess belt would also be stored with the rungs (225) in the storage space (408) in the rotatable base (105). A telescoping hand rail (810) on the ladder units (110) may be included to provide further support for a person using the ladder (100).

The ladder (100) may include an inflatable slide (710) attached to the rotatable base (105) and adapted to enable a person to slide down from the rotatable base (105) to the ground. A manual ladder (730) and a powered platform (720) may also be used to assist in access to and from the ladder units (110).

Figure 3B:
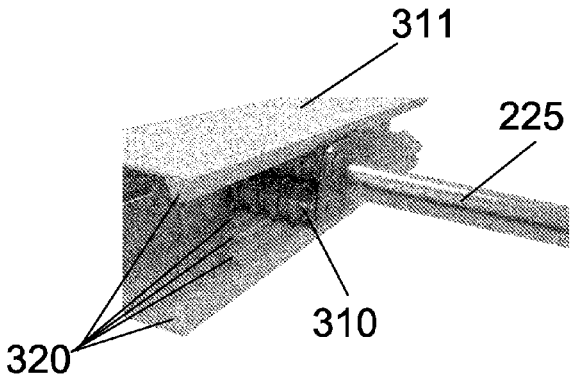
FIG. 3B is a perspective of rung in a C-rail.
Figure 3C:
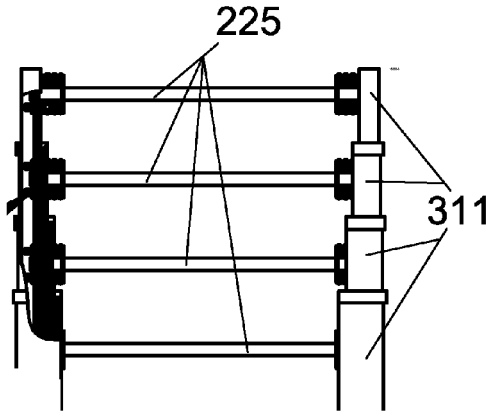
FIG. 3C. is a partial top view of nested C-rails in four ladder units with a cut-out of the C-rails on one side showing the rollers.

FIG. 3 illustrates alternative components of the ladder which include a belt (320) configured to slidably fit within the confined-central space (230) and within the hollow interior of the C-rails (311); and, two rung mounts (310) for each rung (225). The rung mounts (310) are configured to hold each such rung (225) on the belt (320) at a position above the surface of the belt (320).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

Industrial Applicability

The invention has application to land- and water-based fire and rescue industries. It may be used on fire trucks, ship to ship rescue, water to ship rescue, oil drilling platform to ship rescue and in military applications where elevating and rescue from buildings in a hostile environment are possible.

What is claimed is:

1. A ladder that is extensible, vehicle mounted and used to aid in raising and lowering in rescue operations, the ladder comprising:

a rotatable base configured to define storage space within;

a plurality of ladder units comprising at least a first ladder unit and a second ladder unit, configured to be nested together, the plurality of ladder units comprising a first ladder unit attached to the rotatable base and a second ladder unit nested within the first ladder unit, each ladder unit in the plurality of ladder units comprising four C-rails such that when the second ladder unit is nested within the first ladder unit, one of the four C-rails of the first ladder unit contains one of the C-rails for the second ladder unit; and, wherein the ladder units are adapted to be extensible from the rotatable base along a longitudinal axis to a top end;

rungs, each rung comprising two ends, each end attached to rung mounts, each of the rung mounts slidably and directly engaging one of the C-rails of the first ladder unit and one of the C-rails of the second ladder unit when the first ladder unit and the second ladder unit are nested together; and, a drive cable connecting the rungs in a closed loop and powered to:

rotate the rungs around the ladder units within the C-rails; and, extend and retract the rungs from the storage space with movement of the ladder units along the longitudinal axis.

2. The ladder of claim 1, further comprising a spring-loaded take-up spool configured to hold the drive cable and rungs in the rotatable base.

3. The ladder of claim 1, further comprising a redundant power supply comprising a first control at the rotating base and a second control at the top end of the ladder units.

4. The ladder of claim 1, further comprising:

a rung-release mechanism operable to enable the rungs to move in a controlled gravity-assisted descent with a load on the rungs; and, a manual brake to regulate the speed of gravity-assisted descent.

5. The ladder of claim 1, further comprising:

a platform mounted at the top end of the ladder units, operable to enable a person to stand thereon; and, side handrails on the platform, configured to contain the person within the platform.

6. The ladder of claim 5, wherein the platform is adapted to slide outwardly to engage a building.

7. The ladder of claim 1, further comprising a belt adapted to slidably rotate with the rungs and situated between the four C-rails.

8. The ladder of claim 1, further comprising an inflatable slide attached to the rotatable base and adapted to enable a person to slide down from the rotatable base to the ground.

* * * * *